US008452038B2

(12) United States Patent
Buccafusca et al.

(10) Patent No.: US 8,452,038 B2
(45) Date of Patent: May 28, 2013

(54) MULTI-THROAT ACOUSTIC HORN FOR ACOUSTIC FILTERING

(75) Inventors: Osvaldo Buccafusca, Fort Collins, CO (US); Atul Goel, Fort Collins, CO (US); Bruce Beaudry, Windsor, CO (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 472 days.

(21) Appl. No.: 12/769,741

(22) Filed: Apr. 29, 2010

(65) Prior Publication Data

US 2011/0268305 A1 Nov. 3, 2011

(51) Int. Cl.

| | |
|---|---|
| ***H04R 1/22*** | (2006.01) |
| ***H04R 1/30*** | (2006.01) |
| ***G10K 11/04*** | (2006.01) |
| *H04R 1/20* | (2006.01) |
| *G10K 11/02* | (2006.01) |

(52) U.S. Cl.
USPC ..... 381/340; 381/342; 181/187

(58) Field of Classification Search
USPC ..... 381/340, 342; 181/152, 159, 177, 181/187, 188
See application file for complete search history.

(56) References Cited

U.S. PATENT DOCUMENTS

| | | | | | |
|---|---|---|---|---|---|
| 1,740,446 | A * | 12/1929 | Findeisen | 381/338 |
| 1,935,788 | A * | 11/1933 | Critchfield | 340/388.3 |
| 2,458,038 | A * | 1/1949 | Volkmann | 181/188 |
| 4,033,431 | A * | 7/1977 | Ebejer | 181/152 |
| 4,344,504 | A * | 8/1982 | Howze | 181/187 |
| 4,845,759 | A * | 7/1989 | Danley | 381/97 |
| 4,882,562 | A * | 11/1989 | Andrews et al. | 340/388.1 |
| 4,945,334 | A * | 7/1990 | Biersach | 340/388.2 |
| 4,969,196 | A * | 11/1990 | Nakamura | 381/341 |
| 5,526,456 | A * | 6/1996 | Heinz | 381/340 |
| 5,715,322 | A * | 2/1998 | Yoshioka et al. | 381/182 |
| 5,900,593 | A * | 5/1999 | Adamson | 181/152 |
| 6,112,847 | A * | 9/2000 | Lehman | 181/152 |
| 6,394,223 | B1 * | 5/2002 | Lehman | 181/152 |
| 6,668,969 | B2 * | 12/2003 | Meyer et al. | 181/177 |
| 6,925,187 | B2 | 8/2005 | Norris et al. | |
| 7,039,211 | B2 * | 5/2006 | Werner | 381/343 |
| 7,236,606 | B2 * | 6/2007 | Werner | 381/342 |
| 7,392,880 | B2 | 7/2008 | Buck | |
| 7,802,650 | B2 * | 9/2010 | Bartlett | 181/187 |
| 8,121,330 | B2 * | 2/2012 | Dodd et al. | 381/343 |
| 8,194,905 | B1 * | 6/2012 | Vinther, Sr. | 381/342 |
| 8,224,001 | B1 * | 7/2012 | Waller | 381/304 |

(Continued)

OTHER PUBLICATIONS

Dinsdale, "Horn Loudspeaker Design-2", Wireless World, May 1974, pp. 1-6.

(Continued)

*Primary Examiner* — Edgardo San Martin

(57) ABSTRACT

A horn coupled to multiple acoustic transducers includes first and second throat portions and a mixing area integrally formed with the first and second throat portions. The first throat portion has a first throat opening adjacent to a first transducer, and the second throat portion has a second throat opening adjacent to a second transducer. The mixing area includes a common mouth opening shared by the first and second throat portions for at least one of transmitting or receiving acoustic signals. At least one dimension of the first throat portion is different from a corresponding dimension of the second throat portion, so that a first cutoff frequency corresponding to the first throat portion is different from a second cutoff frequency corresponding to the second throat portion.

18 Claims, 5 Drawing Sheets

U.S. PATENT DOCUMENTS

| | | | | |
|---|---|---|---|---|
| 2003/0215107 | A1* | 11/2003 | Werner | 381/343 |
| 2004/0003961 | A1* | 1/2004 | Gunness | 181/189 |
| 2004/0005069 | A1* | 1/2004 | Buck | 381/336 |
| 2006/0233404 | A1 | 10/2006 | Croft et al. | |
| 2009/0046875 | A1* | 2/2009 | Masuda | 381/152 |
| 2009/0087008 | A1* | 4/2009 | Danley | 381/341 |

OTHER PUBLICATIONS

Dinsdale, "Horn Loudspeaker Design", http://www.audion.net/eng/htm_eng/books.htm >; ISBN88-88334-07-6 pp. 116.

* cited by examiner

MULTI-THROAT ACOUSTIC HORN FOR ACOUSTIC FILTERING

BACKGROUND

Generally, horns may be used to amplify acoustic waves, as indicated by incorporation of horns in various musical instruments and early hearing aids, for example. Horns may also be used to manipulate radiation patterns of acoustic emitters, including ultrasonic transducers. Acoustic micro electro-mechanical system (MEMS) transducers, such as ultrasonic transducers including piezoelectric material, are typically more efficient than traditional transducers. However, due to their small size, MEMS transducers have lower effective output power, lower sensitivity and/or broader (less focused) radiation patterns, and thus benefit from being coupled to acoustic horn.

Acoustic horns affect the frequency response of the MEMS transducers and other miniature ultrasonic transducers, effectively acting as high-pass filters with corresponding cutoff frequencies based on the geometry of the acoustic horn. Also, the radiation patterns of the transducers may be manipulated by grouping the transducers into arrays, separated by predetermined distances, in order to provide a desired pattern. By controlling the separation and size of the acoustic horns and/or array elements, as well as the phase among them, cutoff frequencies and acoustic radiation patterns may be manipulated. However, the spacing among transducers is limited by the physical size of the transducers and acoustic horns, and the physical space available for mounting the transducers and acoustic horns.

FIG. 1A is a cross-sectional diagram illustrating an acoustic horn for an ultrasonic or MEMS transducer, for example. As shown in FIG. 1A, acoustic horn 100 is directly coupled to a single ultrasonic transducer 101 (e.g., in contact with the surface of the transducer 101). For example, the acoustic horn 100 may be physically attached to the transducer 101, e.g., by gluing, soldering or bonding. Alternatively, the combined acoustic horn 100 and the transducer 101 may be positioned relative to one another within a package, holding each element in place. The acoustic horn 100 provides better impedance matching, acoustic amplification or radiation pattern control than the transducer 101 alone, in both transmit or receive modes.

FIG. 1B is a cross-sectional diagram illustrating an alternative configuration of an acoustic horn for a MEMS transducer. As shown in FIG. 1B, acoustic horn 100 is coupled to a single ultrasonic transducer 101 by means of pressure chamber 115. This configuration may be implemented, for example, when the acoustic horn 100 is not able to touch the surface of the transducer 101. For example, the presence of wire-bonds may prevent a direct coupling, thus requiring the addition of the pressure chamber 115 for coupling the acoustic horn 100 and the transducer 101. Dimensions of the pressure chamber 115 are less than the acoustic wavelength corresponding to the transducer 101, as would be appreciated by one skilled in the art.

SUMMARY

In a representative embodiment, a horn coupled to multiple acoustic transducers includes a first throat portion having a first throat opening adjacent to a first transducer, a second throat portion having a second throat opening adjacent to a second transducer, and a mixing area integrally formed with the first and second throat portions. The mixing area includes a common mouth opening shared by the first and second throat portions for at least one of transmitting or receiving acoustic signals. At least one dimension of the first throat portion is different from a corresponding dimension of the second throat portion, so that a first cutoff frequency corresponding to the first throat portion is different from a second cutoff frequency corresponding to the second throat portion.

In another representative embodiment, a filtering device for ultrasonic signals includes multiple transducers configured to convert between electrical energy and the ultrasonic signals, and a multi-throat acoustic horn coupled to the transducers. The multi-throat acoustic horn include multiple horn structures having a common mouth opening and multiple throat openings adjacent to the transducers for at least one of transmitting or receiving the ultrasonic signals. The horn structures have corresponding throat structures integrally formed between the common mouth opening and the throat openings, where the throat structures have different growth factors.

In another representative embodiment, an acoustic horn is coupled to multiple acoustic micro electro-mechanical system (MEMS) transducers having the same resonant frequency. The acoustic horn includes a first horn structure having a first throat portion and a first throat opening adjacent to a first transducer, the first throat portion having a first growth factor; a second horn structure having a having a second throat portion and a second throat opening adjacent to a second transducer, the second throat portion having a second growth factor greater than the first growth factor; and a common mouth shared by the first and second horn structures for transporting acoustic signals. A first cutoff frequency corresponding to the first horn structure and a second cutoff frequency corresponding to the second horn structure form a band-pass filter for the acoustic signals, the second cutoff frequency being higher than the first cutoff frequency.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1A:
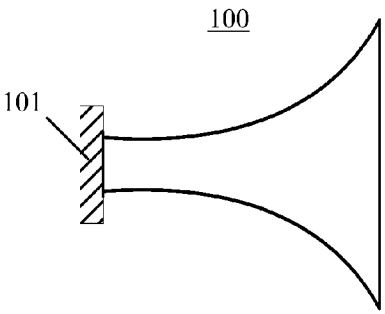
FIG. 1A PRIOR ART
FIGS. 1A and 1B are cross-sectional diagrams illustrating acoustic horn configurations for transducers.

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Generally, it is understood that the drawings and the various elements depicted therein are not drawn to scale. Further, relative terms, such as "above," "below," "top," "bottom," "upper," "lower," "left," "right," "vertical" and "horizontal," are used to describe the various elements' relationships to one another, as illustrated in the accompanying drawings. It is understood that these relative terms are intended to encompass different orientations of the device and/or elements in addition to the orientation depicted in the drawings. For example, if the device were inverted with respect to the view in the drawings, an element described as "above" another element, for example, would now be "below" that element. Likewise, if the device were rotated 90 degrees with respect to the view in the drawings, an element described as "vertical," for example, would now be "horizontal."

Figure 2A:
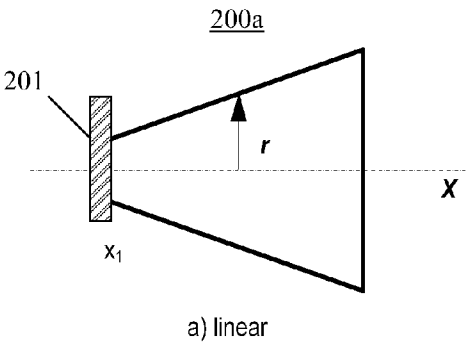
FIG. 2A PRIOR ART
FIGS. 2A and 2B are cross-sectional diagrams illustrating various cross-sectional shapes of acoustic horns for transducers.
Figure 2B:
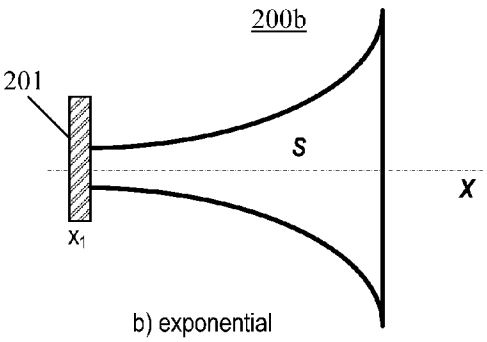
FIG. 2B PRIOR ART

FIGS. 2A and 2B are cross-sectional diagrams illustrating acoustic horns for an ultrasonic transducer. Acoustic horns are generally tubular in shape with circular cross-sections at opposing end openings, where one end (e.g., closest to the acoustic transducer) is typically more narrow than the other. The narrower opening close to the transducer may be referred to as the throat or throat opening of the horn, and the larger opening may be referred to as the mouth or mouth opening of the horn.

FIG. 2A shows an example of an ultrasonic transducer 201, such as a MEMS transducer, coupled to acoustic horn 200*a* having a cross-section of diverging linear sidewalls, which may be referred to as a conical horn since the tube has a generally conical shape. Radius r at any location along the x axis of the acoustic horn 200*a* may be represented by Equation (1), in which $r_1$ is the radius at location $x_1$ of the acoustic horn 200*a* (the throat) and m is the growth factor, indicated by a real number greater than 1:

$$r(x)=mx+r_1 \qquad \text{Equation (1)}$$

A cylinder is a special case of the conical acoustic horn 200*a* in which m=0, such that the radius r at any location x along the cylindrical acoustic horn is equal to $r_1$ of the throat opening.

FIG. 2B shows an example of an ultrasonic transducer 201, such as a MEMS transducer, coupled to an acoustic horn 200*b* having a cross-section of exponentially curved sidewalls, which may be referred to as an exponential horn. In the acoustic horn 200*b*, area S at any location along the x axis of the acoustic horn 200*b* may be represented by the following Equation (2), in which $S_1$ is area at point $x_1$ of the acoustic horn 200*b* (the throat) and m is the growth factor, indicated by a real number greater than 1:

$$S(x)=S_1e^{mx} \qquad \text{Equation (2)}$$

It is understood that other implementations may include an acoustic horn having end openings that are not circular, such as rectangular, square, polygonal and elliptical openings, as well as other functional dependencies of the radius of the horn. Of course, the size and/or shape of the acoustic horn may vary to provide unique benefits for any particular situation or to meet application specific design requirements of various implementations, as would be apparent to one skilled in the art.

The dimensions of an acoustic horn affect its acoustic frequency response. That is, an acoustic horn effectively acts as a high-pass filter having a cutoff frequency based on the geometry of the acoustic horn. For example, for an exponential horn, such as the acoustic horn 221 depicted in FIG. 2B, the cutoff frequency fc is provided by Equation (3), in which c is the speed of sound and m is the exponential growth factor:

$$fc = \frac{mc}{4\pi} \qquad \text{Equation (3)}$$

Therefore, the frequency response of different transmitters or receivers can be manipulated by adjusting the growth factor, for example, by adjusting one or more dimensions of the acoustic horn. In addition, by combining acoustic horns having different dimensions, the resulting different frequency responses effectively provide upper and lower limits of a band-pass filter, as discussed below.

According to various embodiments, a multi-throat acoustic horn includes multiple acoustic horn structures and a common mouth. Each of the acoustic horn structures have throat portions coupled to corresponding acoustic transducers, which have the same resonant frequencies. The frequency responses and corresponding cutoff frequencies provided by the multiple acoustic horn structures differ due to differences in the growth factors (e.g., growth factor m in Equations (1)-(3), above) associated with the acoustic horn structures, respectively. In particular, the acoustic horn structure having the smaller growth factor provides a lower cutoff frequency, and the acoustic horn structure having the larger growth factor provides a higher cutoff frequency. The multi-throat acoustic horn therefore effectively functions as a band-pass filter for acoustic signals received and/or transmitted by the acoustic transducers. The differences in the growth factors may result from differences in various dimensions of the throat portions (e.g., length, diameter of throat openings), discussed below with reference to FIGS. 3A-3B and 5A-5B, and/or variations in the shape of the common mouth, discussed below with reference to FIGS. 6A-6B.

Figure 3B:
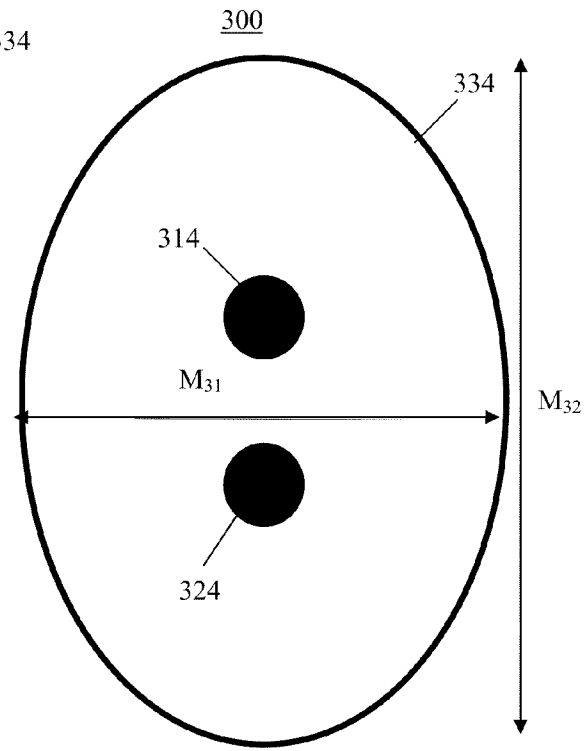
FIG. 3B is a cross-sectional diagram taken from the perspective of a mouth of the multi-throat acoustic horn of FIG. 3A, according to a representative embodiment.
Figure 3A:
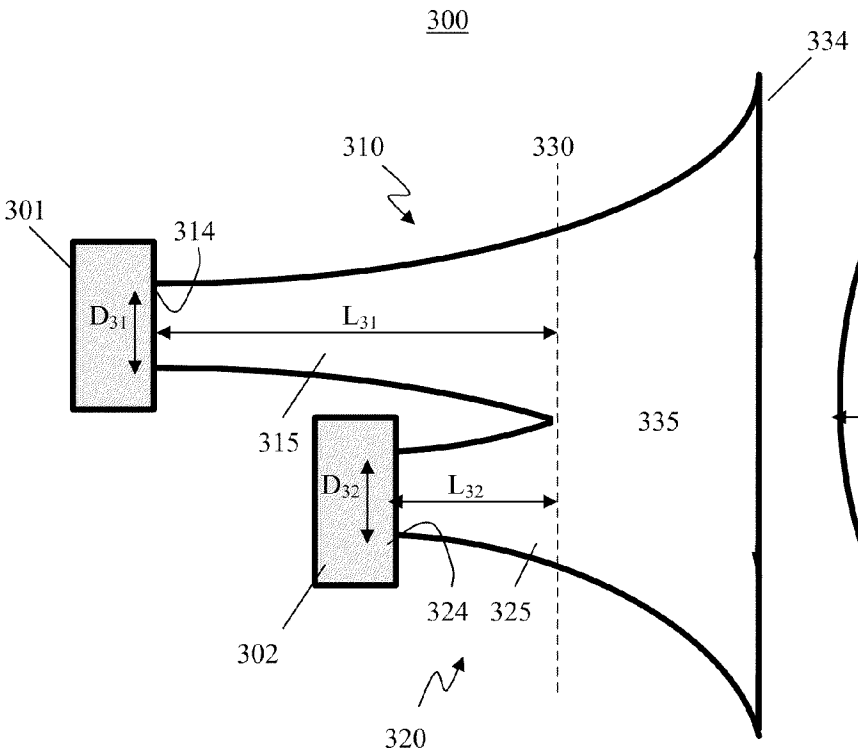
FIG. 3A is a cross-sectional diagram illustrating a multi-throat acoustic horn, according to a representative embodiment.

FIG. 3A is a cross-sectional diagram illustrating a multi-throat acoustic horn, according to a representative embodiment, and FIG. 3B is a cross-sectional diagram taken from the perspective of the mouth opening of the multi-throat acoustic horn of FIG. 3A, according to a representative embodiment.

Figure 1B:
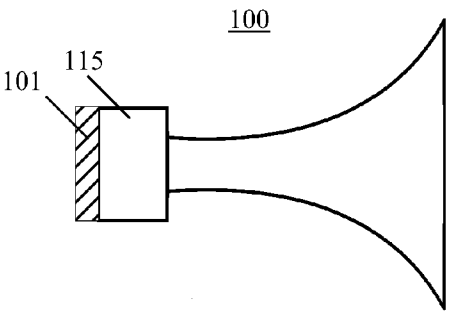
FIG. 1B PRIOR ART

Referring to FIGS. 3A and 3B, multi-throat acoustic horn 300 includes first and second horn structures 310 and 320 that share a common mouth 334. The first and second horn structures 310 and 320 are coupled to acoustic transducers 301 and 302, respectively, which may be MEMS ultrasonic transducers, for example. Although depicted as directly coupled to the acoustic transducers 301 and 302, it is understood that first and second horn structures 310 and 320 may be coupled to the acoustic transducers 301 and 302 by means of corresponding pressure chambers, as discussed above with reference to FIG. 1B, without departing from the scope of the present teachings. In various embodiments, the transducers 301 and 302 have the same frequency response and/or resonant frequency.

The first horn structure 310 includes a first throat portion 315 that extends from a first throat opening 314, which is adjacent to the acoustic transducer 310, to an imaginary boundary line 330 of a mixing area 335. The boundary line 330 is a vertical line marking the plane at which the first and second horn structures 310 and 320 begin to overlap, indicated by the point at which the diverging cross-sectional sidewalls of the first and second throat portions 315 and 325 join. Likewise, the second horn structure 320 includes a second throat portion 325 that extends from a second throat opening 324, which is adjacent to the acoustic transducer 320, to the boundary line 330 of the mixing area 335.

The mixing area 335 includes the common mouth 334, through which acoustic signals are received and/or transmitted by the first and second throat portions 315 and 325. Therefore, the mixing area 335 (like the common mouth 334) is shared by both the first and second horn structures 310 and 320. That is, the mixing area 335 is configured to mix received and/or transmitted acoustic signals for use by both the first and second throat portions 315 and 325. The mixing area minimizes a phase difference between the acoustic signals received and/or transmitted by the first and second transducers 301 and 302.

In the depicted embodiment, the mixing area 335 is integrally formed with the first and second throat portions 315 and 325, and the cross-sectional sidewalls of the mixing area 335 are continuations of the outer sidewalls of the first and second throat portions 315 and 325. Further, in the depicted embodiment, the sidewalls of the mixing area 335 diverge exponentially, similar to the exponential expansion of the cross-sectional outer sidewalls of the first and second throat portions 315 and 325, thus giving the appearance of a continual exponential expansion of the outer sidewalls of the first and second horn structures 310 and 320 from the corresponding first and second throat openings 314 and 324 to the common mouth 334.

However, the mixing area 335 may have various alternative shapes, which may or may not have diverging cross-section sidewalls, without departing from the scope of the present teachings. For example, the cross-section of the mixing area 335 may be substantially rectangular, such that the exponential expansion of the cross-sectional outer sidewalls of the first and second horn structures 310 and 320 ends at the boundary line 330. The shape and dimensions of the mixing area 330 may vary to provide unique benefits for any particular situation or to meet application specific design requirements of various implementations, as would be apparent to one skilled in the art.

In the depicted representative embodiment, the first throat portion 315 has a first length $L_{31}$ extending along a center axis from the first throat opening 314 to the boundary line 330, and the second throat portion 325 has a second length $L_{32}$ extending along a center axis from the second throat opening 324 to the boundary line 330. Also, as shown in FIG. 3B, for example, the first and second throat openings 314 and 324 have corresponding open areas that are circular and the common mouth 334 is elliptical. Therefore, for purpose of discussion, the open area of the first throat opening 314 is indicated by diameter $D_{31}$ and the open area of the second throat opening 324 is indicated by diameter $D_{32}$. It is understood that the shapes of the open areas may vary to provide unique benefits for any particular situation or to meet application specific design requirements of various implementations, as would be apparent to one skilled in the art. For example, each of the open areas of the first and second throat openings 314 and 324 may rectangular, square, polygonal, elliptical, etc.

In addition, the first and second acoustic horn structures 310 and 320 have different growth factors, e.g., indicated by growth factor m in Equations (1) through (3), as discussed above. The growth factor indicates the rate at which the cross-sectional sidewalls of the first and second throat portions 315 and 325 diverge. In the depicted embodiment, the first and second throat portions 315 and 325 essentially have exponentially curved sidewalls, discussed above with reference to FIG. 2B, for example. Also, the diameter $D_{31}$ of the first throat opening 314 is the same as the diameter $D_{32}$ of the second throat opening 324. However, the first length $L_{31}$ of the first throat portion 315 is longer than the second length $L_{32}$ of the second throat portion 325. Accordingly, the sidewalls of the (shorter) second throat portion 325 diverge at a higher exponential rate than the sidewalls of the first throat portion 315, and thus the second throat portion 325 has a larger growth factor than the first throat portion 315.

Generally, the acoustic horn structure having throat portion with the larger growth factor has a higher cutoff frequency. Therefore, in the depicted embodiment, a second cutoff frequency $fc_2$ of the second acoustic horn structure 320 is larger than a first cutoff frequency $fc_1$ of the first acoustic horn structure 310, as determined for example by Equation (3).

Figure 4:
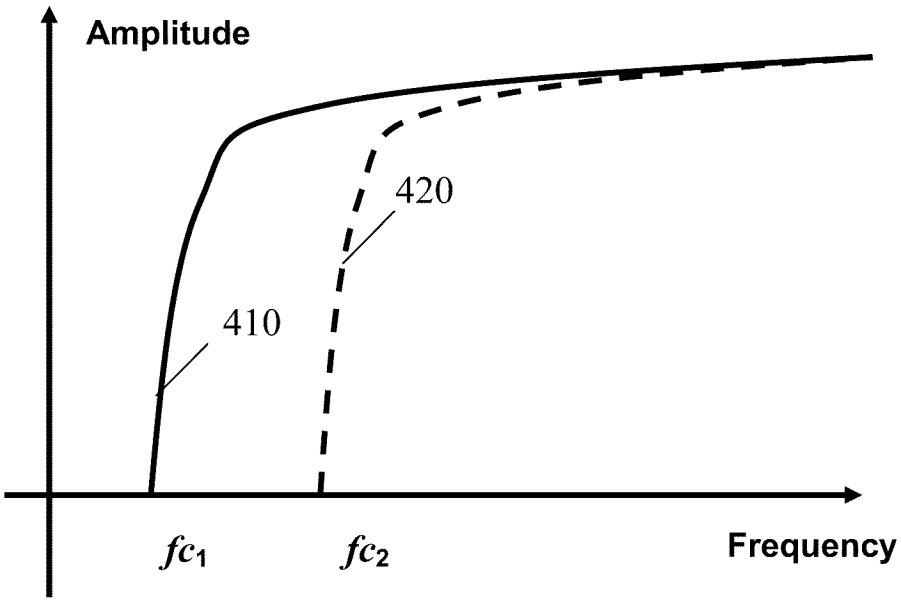
FIG. 4 is a graph showing estimated frequency responses provided by first and second acoustic horn structures of the multi-throat acoustic horn of FIG. 3A, according to a representative embodiment.

FIG. 4 is a graph showing estimated frequency responses provided by the first and second acoustic horn structures 310 and 320 of FIGS. 3A and 3B. In particular, curve 410 corresponds to the frequency response provided by the first acoustic horn structure 310, and the first cutoff frequency $fc_1$ is the frequency at which the curve 410 has an amplitude of zero. Likewise, curve 420 corresponds to the frequency response provided by the second first acoustic horn structure 320, and the second cutoff frequency $fc_2$ is the frequency at which the curve 420 has an amplitude of zero. As stated above, the first cutoff frequency $fc_1$ is less than the second cutoff frequency $fc_2$. In addition, the difference between the first and second cutoff frequencies $fc_1$ and $fc_2$ is the passband of the multi-throat acoustic horn 300.

Generally, use of a multi-throat acoustic horn, such as multi-throat acoustic horn 300, enables manipulation of the frequency response of acoustic systems, e.g., including the first and second transducers 301 and 302. For example, the signal of the first transducer 301 may be subtracted from the signal of the second transducer 302 in order to produce a bandpass acoustic receiver/transmitter with noise cancellation. For example, in a receive mode, the signals of the first and second transducers 301 and 302 may be input to a differential amplifier (not shown), which outputs the difference signal. An advantage of using the differential amplifier is that no electrical filtering is required.

Of course, the growth factors of the first and second acoustic horn structures 310 and 320 may be manipulated by altering the first and second diameters $D_{31}$ and $D_{32}$ and/or the first and second lengths $L_{31}$ and $L_{32}$, as well as by altering the size and/or shape of the mixing area 335 and/or the common mouth 334, as discussed below with reference to FIGS. 5A-6B. Also, the cross-section sidewalls of the first and second acoustic horn structures 310 and 320 may diverge linearly, as opposed to exponentially, which may simplify the manufacturing process.

The multi-throat acoustic horn 300 may be formed from any material capable of being formed into predetermined shapes to provide the desired cutoff frequencies and bandpass characteristics. For example, the acoustic horn structures 310 and 320 the multi-throat acoustic horn 300 may be formed from a lightweight plastic or metal. Also, the acoustic horn structures 310 and 320 may be relatively small to accommodate receiving and transmitting ultrasonic signals. For example, if the first and second transducers 301 and 302 are MEMS devices, each of the diameters $D_{31}$ and $D_{32}$ may be about 0.1 mm to about 5 mm, and the lengths $L_{31}$ and $L_{32}$ may be about 1 mm to about 20 mm. The ratio between the two lengths $L_{31}/L_{32}$ is provided by the desired frequency response and may vary from about 1.1 to about 10, for example. Also, the common mouth 334 may have a first diameter $M_{31}$ of about 1 mm to about 10 mm and a second diameter $M_{32}$ of about 2 mm to about 20 mm, for example. However, the dimensions may vary to provide unique benefits for any particular situation or to meet application specific design requirements of various implementations, as would be apparent to one skilled in the art.

When the transducers 301 and 302 operate in transmit mode, they receive electrical energy from a signaling source (not shown), and emit ultrasonic waves within the passband via the multi-throat acoustic horn 300 corresponding to vibrations induced by the electrical input. When the transducers 301 and 302 operate in receive mode, they receive ultrasonic waves from an acoustic source (not shown) within the passband collected through the common mouth 334 of the multi-throat acoustic horn 300 and convert the sound into electrical energy.

Figure 5B:
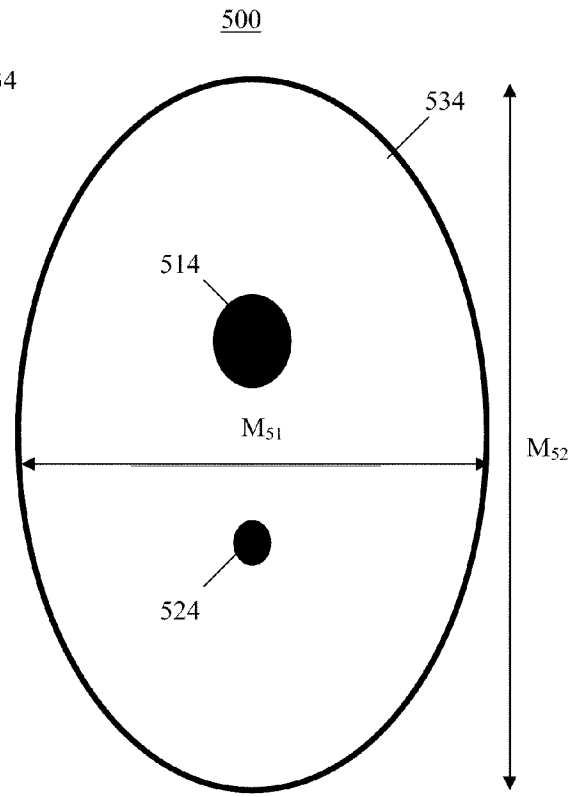
FIG. 5B is a cross-sectional diagram taken from the perspective of a mouth of the multi-throat acoustic horn of FIG. 5A, according to a representative embodiment.
Figure 5A:
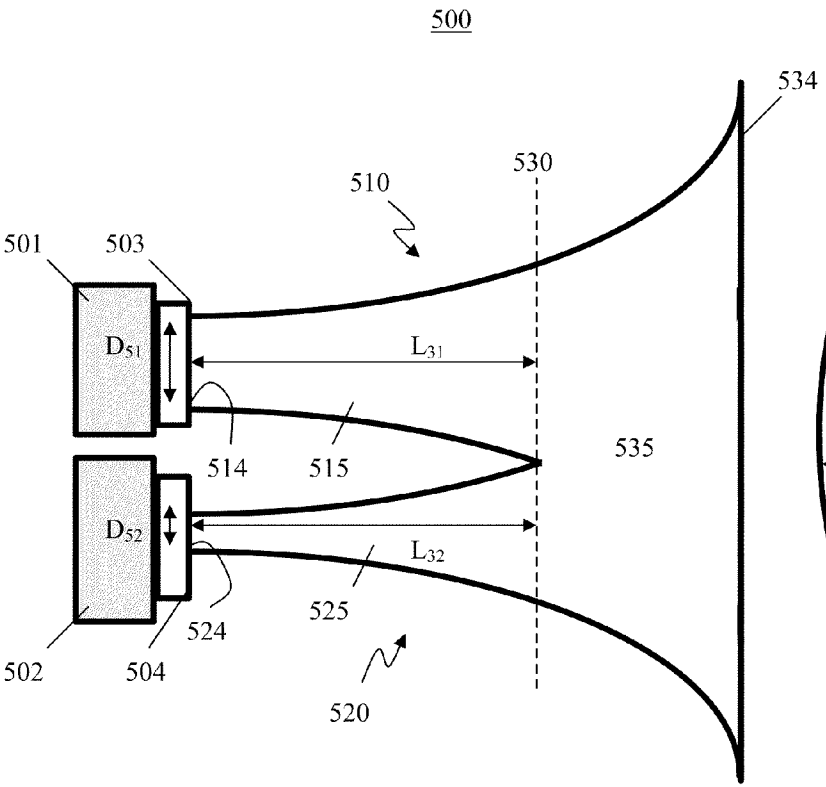
FIG. 5A is a cross-sectional diagram illustrating a multi-throat acoustic horn, according to a representative embodiment.

FIG. 5A is a cross-sectional diagram illustrating a multi-throat acoustic horn, according to another representative embodiment, and FIG. 5B is a cross-sectional diagram taken from the perspective of the mouth opening of the multi-throat acoustic horn of FIG. 5A, according to a representative embodiment. Generally, as compared to FIGS. 3A and 3B, the multiple throat portions of the multi-throat acoustic horn shown in FIGS. 5A and 5B have the same lengths and different size throat openings, while the multiple throat portions of the multi-throat acoustic horn shown in FIGS. 3A and 3B have the same size throat openings and different lengths.

Referring to FIGS. 5A and 5B, multi-throat acoustic horn 500 includes first and second horn structures 510 and 520 that share a common mouth 534. The first and second horn structures 510 and 520 are coupled to acoustic transducers 501 and 502, respectively, which may be MEMS ultrasonic transducers, for example. In the depicted embodiment, the first and second acoustic transducers 501 are coupled to the multi-throat acoustic horn 500 through corresponding pressure chambers 503 and 504, respectively, which may be necessary for appropriate acoustic coupling. However, it is understood that first and second horn structures 510 and 520 may be directed coupled to the acoustic transducers 501 and 502, as discussed above with reference to FIG. 1A, without departing from the scope of the present teachings. In various embodiments, the transducers 501 and 502 have the same resonant frequency.

The first horn structure 510 includes a first throat portion 515 that extends from a first throat opening 514, which is adjacent to the acoustic transducer 501, to an imaginary boundary line 530 of a mixing area 535. The boundary line 530 is a vertical line marking the plane at which the first and second horn structures 510 and 520 begin to overlap, indicated by the point at which the diverging cross-sectional sidewalls of the first and second throat portions 515 and 525 join. Likewise, the second horn structure 520 includes a second throat portion 525 that extends from a second throat opening 524, which is adjacent to the acoustic transducer 520, to the boundary line 530 of the mixing area 535.

The mixing area 535 includes the common mouth 534, through which acoustic signals are received and/or transmitted by the first and second throat portions 515 and 525. Therefore, the mixing area 535 (like the common mouth 534) is shared by both the first and second horn structures 510 and 520. The configuration and functionality of the mixing area 535 are substantially the same as the configuration and functionality of the mixing area 335 discussed above with reference to FIGS. 3A and 3B, and thus the description will not be repeated.

In the depicted representative embodiment, the first throat portion 515 has a first length $L_{51}$ extending along a center axis from the first throat opening 514 to the boundary line 530, and the second throat portion 525 has a second length $L_{52}$ extending along a center axis from the second throat opening 524 to the boundary line 530. Also, as shown in FIG. 5B, for example, the first and second throat openings 514 and 524 have corresponding open areas that are circular and the common mouth 534 is elliptical. Therefore, for purpose of discussion, the open area of the first throat opening 514 is indicated by diameter $D_{51}$ and the open area of the second throat opening 524 is indicated by diameter $D_{52}$. Also, It is understood that the shapes of the open areas may vary to provide unique benefits for any particular situation or to meet application specific design requirements of various implementations, as would be apparent to one skilled in the art, as discussed above with reference to the first and second throat openings 314 and 324 of FIGS. 3A and 3B.

In addition, the first and second acoustic horn structures 510 and 520 have different growth factors, as discussed above. In the depicted embodiment, the length $L_{51}$ of the first throat portion 515 is the same as the length $L_{52}$ of the second throat portion 525. However, the diameter $D_{51}$ of the first throat opening 514 is larger than the diameter $D_{52}$ of the second throat opening 524. Accordingly, the sidewalls of the (narrower) second throat portion 525 diverge at a higher exponential rate than the sidewalls of the first throat portion 515, and thus the second throat portion 525 has a larger growth factor than the first throat portion 515. Therefore, because the acoustic horn structure having the throat portion with the larger growth factor has the higher cutoff frequency, as discussed above, a second cutoff frequency $fc_2$ of the second acoustic horn structure 520 is larger than a first cutoff frequency $fc_1$ of the first acoustic horn structure 510, as determined for example by Equation (3), and the difference between the first and second cutoff frequencies $fc_1$ and $fc_2$ is the passband of the multi-throat acoustic horn 500.

In a representative configuration, each of the lengths $L_{51}$ and $L_{52}$ may be about 1 mm to about 20 mm, and each of the diameters $D_{51}$ and $D_{52}$ may be about 0.1 mm to about 5 mm, for example, where the ratio between the diameters $D_{51}/D_{52}$ may vary from about 1.1 to about 10, for example. Also, the common mouth 534 may have a first diameter $M_{51}$ of about 1 mm to about 10 mm and a second diameter $M_{52}$ of about 2 mm to about 20 mm, for example. However, the dimensions may vary to provide unique benefits for any particular situation or to meet application specific design requirements of various implementations, as would be apparent to one skilled in the art.

Figure 6B:
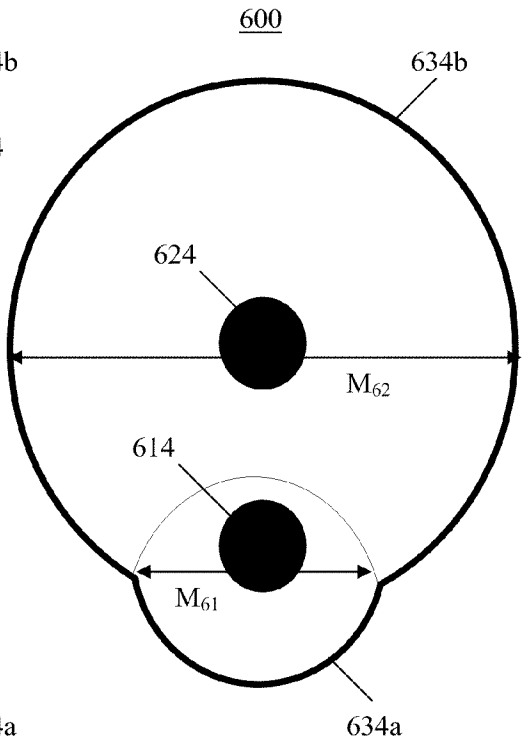
FIG. 6B is a cross-sectional diagram taken from the perspective of a mouth of the multi-throat acoustic horn of FIG. 6A, according to a representative embodiment.
Figure 6A:
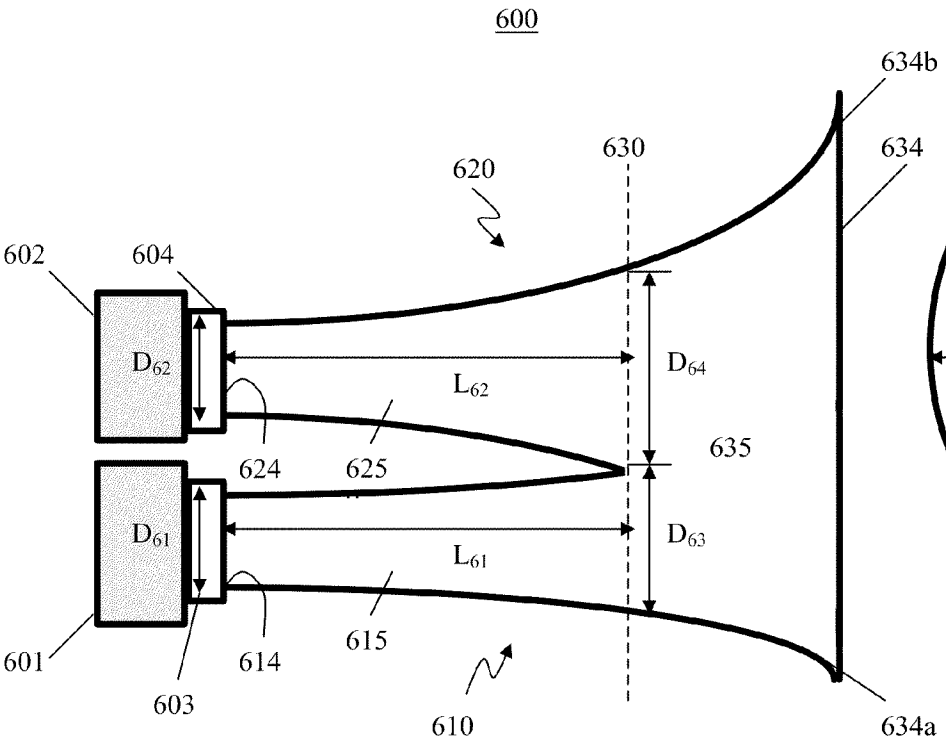
FIG. 6A is a cross-sectional diagram illustrating a multi-throat acoustic horn, according to a representative embodiment.

FIG. 6A is a cross-sectional diagram illustrating a multi-throat acoustic horn, according to another representative embodiment, and FIG. 6B is a cross-sectional diagram taken from the perspective of the mouth opening of the multi-throat acoustic horn of FIG. 6A, according to a representative embodiment. Generally, as compared to FIGS. 3A and 3B, the multiple throat portions of the multi-throat acoustic horn shown in FIGS. 6A and 6B have the same lengths and the same size throat openings. However, a common mouth of the multi-throat acoustic horn includes multiple mouth portions with different dimensions corresponding to the multiple throat portions, while the common mouth of the multi-throat acoustic horn shown in FIGS. 3A and 3B is a single, integrated shape.

Referring to FIGS. 6A and 6B, multi-throat acoustic horn 600 includes first and second horn structures 610 and 620 that share corresponding portions of a common mouth 634, indicated as first mouth portion 634*a* and second mouth portion 634*b*. The first and second horn structures 610 and 620 are coupled to acoustic transducers 601 and 602, respectively, which may be MEMS ultrasonic transducers, for example. In the depicted embodiment, the first and second acoustic transducers 601 are coupled to the multi-throat acoustic horn 600 through corresponding pressure chambers 603 and 604, respectively, which may be necessary for appropriate acoustic coupling. However, it is understood that first and second horn structures 610 and 620 may be directed coupled to the acoustic transducers 601 and 602, as discussed above with reference to FIG. 1A, without departing from the scope of the present teachings. In various embodiments, the transducers 601 and 602 have the same resonant frequency.

The first horn structure 610 includes a first throat portion 615 that extends from a first throat opening 614, which is adjacent to the acoustic transducer 601, to an imaginary boundary line 630 of a mixing area 635. The boundary line 630 is a vertical line marking the plane at which the first and second horn structures 610 and 620 begin to overlap, indicated by the point at which the diverging cross-sectional sidewalls of the first and second throat portions 615 and 625 join. Likewise, the second horn structure 620 includes a second throat portion 625 that extends from a second throat opening 624, which is adjacent to the acoustic transducer 620, to the boundary line 630 of the mixing area 635.

The mixing area 635 includes the common mouth 634, through which acoustic signals are received and/or transmitted by the first and second throat portions 615 and 625. However, in the depicted embodiment, the common mouth 634 includes the first and second mouth portions 634*a* and 634*b* corresponding to the first and second throat portions 615 and 625, respectively. As shown in FIG. 6B, for example, the first mouth portion 634*a* is smaller than the second mouth portion 634*b*, and protrudes from an outer (bottom) edge of the second mouth portion 634*b* to be at least partially aligned with a center axis of the first throat portion 615. The first and second mouth portions 634*a* and 634*b* thus partially overlap one another within the common mouth 634.

For example, the illustrative first mouth portion 634*a* shown in FIG. 6B is substantially circular in shape with a diameter of $M_{61}$, where the center of the circle is slightly offset (downward) from the center axis of the first throat portion 615. The illustrative second mouth portion 634*b* is also substantially circular in shape with a diameter of $M_{62}$, which is larger than the diameter $M_{61}$, where the center of the circle is substantially aligned with the center axis of the second throat portion 625. Accordingly, because the first and second throat portions 615 and 625 have different size overlapping mouth portions, the corresponding growth factors (and thus cutoff frequencies $fc_1$ and $fc_2$) are also different. Of course, the respective relative sizes and shapes of the first and second mouth portions 634*a* and 634*b* may vary to provide unique benefits for any particular situation or to meet application specific design requirements of various implementations, as would be apparent to one skilled in the art.

More particularly, in the depicted representative embodiment, the first throat portion 615 has a first length $L_{61}$ extending along a center axis from the first throat opening 614 to the boundary line 630, and the second throat portion 625 has a second length $L_{62}$ extending along a center axis from the second throat opening 624 to the boundary line 630. Also, as shown in FIG. 6B, for example, the first and second throat openings 614 and 624 have corresponding open areas that are circular. Therefore, for purpose of discussion, the open area of the first throat opening 614 is indicated by diameter $D_{61}$ and the open area of the second throat opening 624 is indicated by diameter $D_{62}$. It is understood that the shapes of the open areas may vary to provide unique benefits for any particular situation or to meet application specific design requirements of various implementations, as would be apparent to one skilled in the art, as discussed above with reference to the first and second throat openings 314 and 324 of FIGS. 3A and 3B.

In addition, the length $L_{61}$ of the first throat portion 615 is the same as the length $L_{62}$ of the second throat portion 625, and the diameter $D_{61}$ of the first throat opening 614 is the same as the diameter $D_{62}$ of the second throat opening 624. However, because the first mouth portion 634*a* corresponding to the first throat portion 615 is smaller than the second mouth portion 634*b* corresponding to the first throat portion 625, as discussed above, the cross-sectional sidewalls of the first throat portion 615 diverge at a lower exponential rate than the cross-sectional sidewalls of the first throat portion 615, as shown in FIG. 6A. Thus, the second throat portion 625 has a larger growth factor than the first throat portion 615. Therefore, because the acoustic horn structure having the throat portion with the larger growth factor has the higher cutoff frequency, as discussed above, the second cutoff frequency $fc_2$ of the second acoustic horn structure 620 is larger than the first cutoff frequency $fc_1$ of the first acoustic horn structure 610, as determined for example by Equation (3), and the difference between the first and second cutoff frequencies $fc_1$ and $fc_2$ is the passband of the multi-throat acoustic horn 600.

In a representative configuration, each of the lengths $L_{61}$ and $L_{62}$ may be about 1 mm to about 20 mm, and each of the inner diameters $D_{61}$ and $D_{62}$ of the first and second throat portions 615 and 625 may be about 0.1 mm to about 5 mm, for example. Also, as an additional parameter, the outer diameters $D_{63}$ and $D_{64}$ of the throat portions 615 and 625 at the plane indicated by the boundary line 630 may be about 0.1 mm to about 5 mm, where the ratio between the outer diameters $D_{63}/D_{64}$ may vary from about 1.1 to about 10, for example. Also, referring to the partially overlapping mixing regions at the first and second mouth portions 634*a* and 634*b*, each of the first and second diameters $M_{61}$ and $M_{62}$ may be about 1 mm to about 10 mm, for example. However, the dimensions may vary to provide unique benefits for any particular situation or to meet application specific design requirements of various implementations, as would be apparent to one skilled in the art.

The various components, materials, structures and parameters are included by way of illustration and example only and not in any limiting sense. In view of this disclosure, those skilled in the art can implement the present teachings in determining their own applications and needed components, materials, structures and equipment to implement these applications, while remaining within the scope of the appended claims.

The invention claimed is:

1. A horn coupled to a plurality of acoustic transducers, the horn comprising:

a first throat portion having a first throat opening adjacent to a first transducer;

a second throat portion having a second throat opening adjacent to a second transducer having the same resonant frequency as the first transducer; and a mixing area integrally formed with the first and second throat portions, the mixing area comprising a common mouth opening shared by the first and second throat portions for at least one of transmitting or receiving acoustic signals, wherein at least one dimension of the first throat portion is different from a corresponding dimension of the second throat portion, so that a first cutoff frequency corresponding to the first throat portion is different from a second cutoff frequency corresponding to the second throat portion.

2. The device of claim 1, wherein the first and second cutoff frequencies form a bandpass for the acoustic signals.

3. The device of claim 2, wherein the first throat portion has a first growth factor corresponding to a rate of expansion of cross-sectional sidewalls of the first throat portion from the first throat opening to the mixing area, and wherein the second throat portion has a second growth factor corresponding to a rate of expansion of cross-sectional sidewalls of the second throat portion from the second throat opening to the mixing area, the second growth factor being different from the first growth factor.

4. The device of claim 3, wherein the first cutoff frequency is greater than the second cutoff frequency when the first growth factor is greater than the second growth factor.

5. The device of claim 1, wherein the first throat portion has a first length from the first throat opening to the mixing area and the first throat opening has a first open area, and wherein the second throat portion has a second length from the second throat opening to the mixing area and the second throat opening has a second open area.

6. The device of claim 5, wherein the first length is longer than the second length and the first open area is the same as the second open area.

7. The device of claim 5, wherein the first length is the same as the second length and the first open area is greater than the second open area.

8. The device of claim 5, wherein the mixing area comprises a first mouth portion corresponding to the first throat portion and a second mouth portion corresponding to the second throat portion, the first and second mouth portions having different sizes.

9. The device of claim 8, wherein the first length is the same as the second length and the first open area is the same as the second open area, and wherein the first mouth portion is greater than the second mouth portion.

10. The device of claim 2, wherein each of the first and second transducers comprises a micro electro-mechanical system (MEMS) transducer.

11. The device of claim 10, wherein the mixing area minimizes a phase difference between the acoustic signals transmitted or received by the first and second transducers.

12. A filtering device for ultrasonic signals, the device comprising:

a plurality of transducers configured to convert between electrical energy and the ultrasonic signals, the plurality of transducers having the same resonant frequency; and a multi-throat acoustic horn coupled to the transducers, the multi-throat acoustic horn comprising a plurality of horn structures having a common mouth opening and a plurality throat openings adjacent to the plurality of transducers for at least one of transmitting or receiving the ultrasonic signals, the plurality of horn structures having a corresponding plurality of throat structures integrally formed between the common mouth opening and the plurality of throat openings, the plurality of throat structures having different growth factors.

13. The device of claim 12, wherein the plurality of horn structures provide different frequency responses and different cutoff frequencies.

14. The device of claim 13, wherein a difference between the cutoff frequencies provides a band-pass filter for the transmitted or received ultrasonic signals.

15. The device of claim 14, further comprising:

a differential amplifier configured to output a difference signal corresponding to the difference between the cutoff frequencies.

16. The device of claim 14, wherein the plurality of throat structures have the same length and the plurality of throat openings have different open areas, the horn structure having the smallest throat opening having the largest growth factor and cutoff frequency.

17. The device of claim 14, wherein the plurality of throat structures have different lengths and the plurality of throat openings have the same size open areas, the horn structure having the corresponding throat structure with the shortest length having the largest growth factor and cutoff frequency.

18. An acoustic horn coupled to a plurality of acoustic micro electro-mechanical system (MEMS) transducers having the same resonant frequency, the acoustic horn comprising:

a first horn structure having a first throat portion and a first throat opening adjacent to a first transducer, the first throat portion having a first growth factor;

a second horn structure having a second throat portion and a second throat opening adjacent to a second transducer having the same resonant frequency as the first transducer, the second throat portion having a second growth factor greater than the first growth factor; and a common mouth shared by the first and second horn structures for transporting acoustic signals, wherein a first cutoff frequency corresponding to the first horn structure and a second cutoff frequency corresponding to the second horn structure form a band-pass filter for the acoustic signals, the second cutoff frequency being higher than the first cutoff frequency.

* * * * *